US006167858B1

(12) United States Patent
Murakami

(10) Patent No.: US 6,167,858 B1
(45) Date of Patent: Jan. 2, 2001

(54) CRANK PULLEY FOR RECOIL STARTER

(75) Inventor: Masayuki Murakami, Saitama (JP)

(73) Assignee: Showakiki Industry Co., Ltd., Saitama (JP)

( * ) Notice: Under 35 U.S.C. 154(b), the term of this patent shall be extended for 0 days.

(21) Appl. No.: 08/988,777

(22) Filed: Dec. 11, 1997

(30) Foreign Application Priority Data

Apr. 8, 1997 (JP) ..... 9-105328

(51) Int. Cl.[7] ..... F02N 3/02
(52) U.S. Cl. ..... 123/185.3; 74/7 C; 192/42
(58) Field of Search ..... 123/185.2, 185.3, 123/185.4; 74/7 C; 192/42

(56) References Cited

U.S. PATENT DOCUMENTS 2,374,685 * 5/1945 Kissel et al. ..... 123/185.3
2,709,994 * 6/1955 Chandler ..... 123/185.3
4,638,775 * 1/1987 Lindström ..... 123/185.3

* cited by examiner

*Primary Examiner*—Andrew M. Dolinar
(74) *Attorney, Agent, or Firm*—Armstrong, Westerman, Hattori, McLeland & Naughton

(57) ABSTRACT

A crank pulley for a recoil starter is disclosed, in which a touching nail 12 is integrally provided in a recoil starter side by a press forming process in a shape of a protrusion. The touching nail has an L shape by bending in a reverse rotation direction, and a bending top face forms a contact dog. A corner of the touching part of at a top of the touching nail, and an outer corner part at the bending part of the touching nail, are formed into a curved or chamfered shape, and the dog is capable of being moved to the engine side, during a starting operation.

4 Claims, 5 Drawing Sheets

CRANK PULLEY FOR RECOIL STARTER

BACKGROUND OF THE INVENTION

1. Field of the Invention

The present invention concerns a pulley for a recoil starter, more particularly those which provide a dog which is capable of moving towards the engine side along an axis at a time for starting operation, and a touching nail, which is attached to a crank shaft opposing thereto, and is capable of contacting with said dog (hereinafter simply referred to as crank pulley).

2. Description of the Related Art

In Japanese Patent Application No. Hei 8-94470 (Japanese Patent Application Kokai No. Hei 9-105371), a recoil starter is disclosed, in which a reel which may be revolved by pulling a rope, and a dog made of synthetic resin, which is capable of moving to axial direction by revolving said reel, are provided, and by moving said dog to a protrusion on a fly wheel, or the crank pulley side made of alloy die-cast, thereby contacting a contact face on the dog to a protrusion on a fly wheel, or a touching nail provided on the crank pulley, to start rotating thereof.

In the recoil starter having a constitution, as disclosed above, it is required to use a crank pulley of die casting alloy, when no protrusion is provided on the fly wheel, however, said crank pulley must become expensive. Since the crank pulley may be obtained economically, provided that the crank pulley may be made by press forming, it is required to modify a shape of the crank pulley into those which are capable of being easily formed by press forming.

Various shapes, which are capable of press forming, may be considered, and the most simple way is, for example, shown in FIG. 7, wherein a touching nail 18 is formed by cutting a partial end of the crank pulley 19, to bend the notched part along parallel to an axis thereof thereby forming an extrusion. In this case, a contact face 5 of the dog 4 in the recoil starter 1, and a contact face 18 of the touching nail are not firmly attached to each other all over the faces, due to an error during forming parts, clearances between assembled parts, and the like, resulting in causing a slight slant (θ). Accordingly, both contacting parts are liable of sliding to cause unstable contact.

Furthermore, in the crank pulley of such a recoil starter, a distance between the crank pulley 19 and dog 4 of the recoil starter 1 becomes larger at a certain frequency to cause unacceptable and unstable contact, as shown in FIG. 2. Under such a state, since remarkably strong power may be applied between both parts, a contact with a touching nail 12 is liable to be released, as shown by the dotted line in FIG. 2. At that time, a top part 7 of the dog 4 is damaged by the touching nail 12.

Besides these, in the recoil starter of this type, soon after the engine being started, revolution of the pulley 10 becomes faster than that of the dog 4. Accordingly, a relative revolving direction between the crank pulley 10 and the dog 4 comes to reversal, regardless of concurrent revolving on starting the engine, thereby accidentally hitting the touching nail 12 onto a back face 6 of the dog 4, resulting in proceeding movement relatively towards arrow A direction. At this collision, the dog 4 may be damaged.

These problems may be similarly caused not only on starting the engine, but also by erroneously pulling the starting rope during running the engine, or by moving the dog to the crank pulley side due to abnormal vibration, and the like.

The present invention has an object for providing a novel crank pulley for recoil starter for overcoming several problems, discussed above, at once.

SUMMARY OF THE INVENTION

An object of the present invention is to provide a crank pulley comprising a recoil starter providing dog which is capable of moving towards an engine side along an axial direction during a starting operation, and a touching nail which provided on a crank axis of engine opposite thereof, and is capable of engaging with said dog, wherein said touching nail is integrally formed with the crank pulley by press forming in a shape of protrusion towards the recoil starter side, and a top of said touching nail is bent towards the recoil starter side in L shape, a top face of which is formed as attaching face with said dog, and a corner of a top attaching part of the touching nail at the recoil starter side is formed into either curve or chamfer face, and outer corner part in bent part of the touching nail is formed into either curved or chamfered face.

Preferably, a rib is formed between the touching nail and the flange in the crank pulley. More preferably, the touching nail may be protruded by slanting towards a direction opposite to the revolving direction of the crank pulley.

Both corner parts in the radius direction of the contacting face in the touching nail may be shaped in a curve or chamfer face.

The crank pulley for recoil starter according to the present invention may be supplied with a cheaper price by applying a press forming process. Besides this, since a thickness of the contact part of the crank pulley with a contacting face of the dog is as thin as of a thickness of raw steel material in radial direction, there is no trouble in unstable contact, even if a slight slant may be caused between a contact face of the dog and that of the crank pulley due to an error in production of parts, or clearance in the assembled product.

DETAILED DESCRIPTION AND THE PREFERRED EMBODIMENTS

Figure 1:
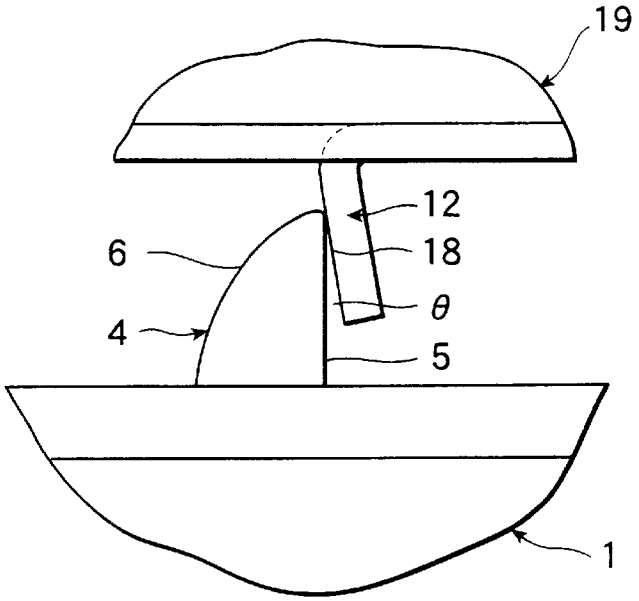
FIG.1 PRIOR ART
FIG. 1 shows a partial side view of one embodiment for prior art the crank pulley for recoil starter.
Figure 2:
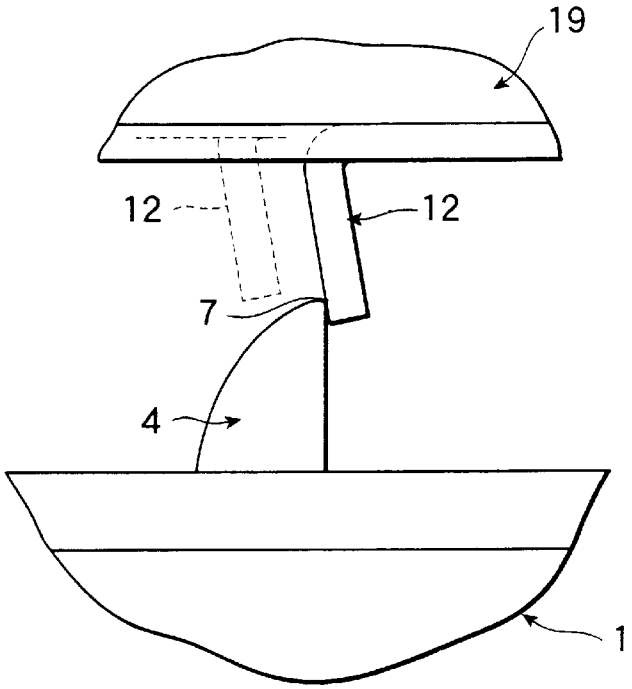
FIG.2 PRIOR ART
FIG. 2 shows a partial side view of explanation drawing for function of the crank pulley according to the FIG. 1.
Figure 3:
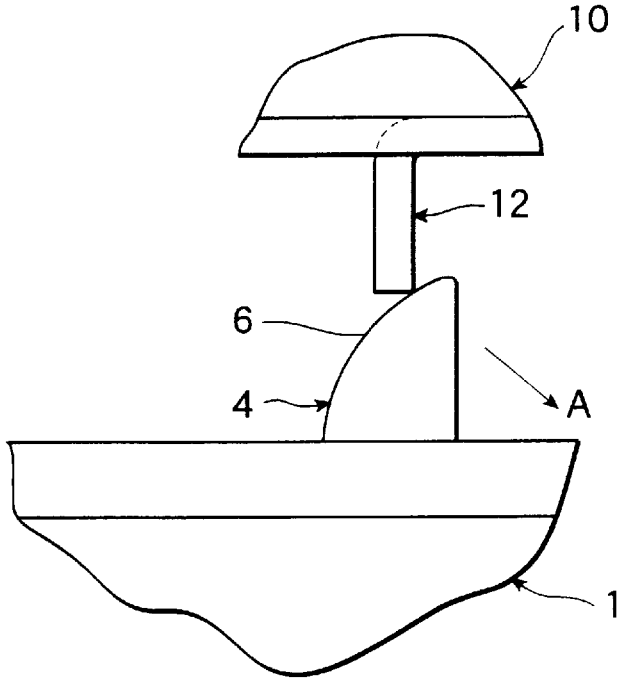
FIG.3 PRIOR ART
FIG. 3 shows a partial side view of explanation drawing for function of the crank pulley according to the FIG. 1.

The present invention is explained in detailed, referring to the drawings, which show the embodiment of the present invention.

Figure 4:
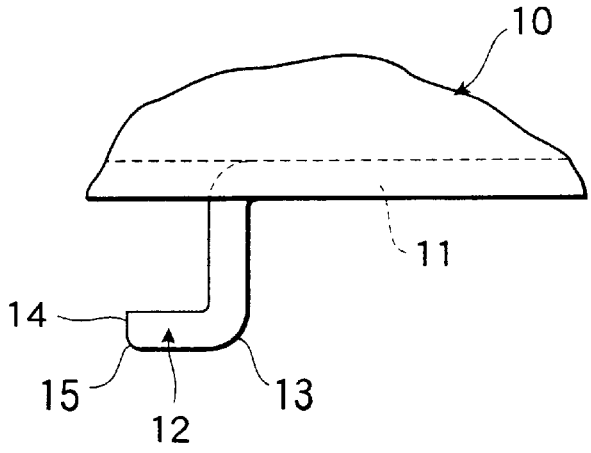
FIG. 4 shows a partial side view of the crank pulley according to the present invention.
Figure 5:
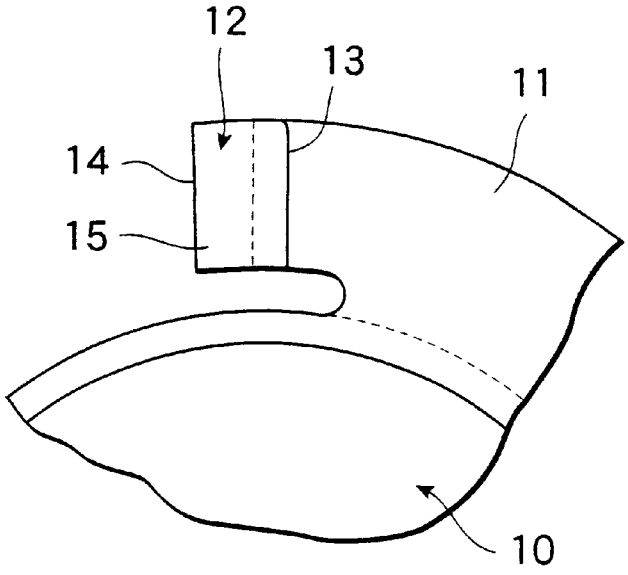
FIG. 5 shows a partial bottom view of the crank pulley according to FIG. 4.
Figure 6:
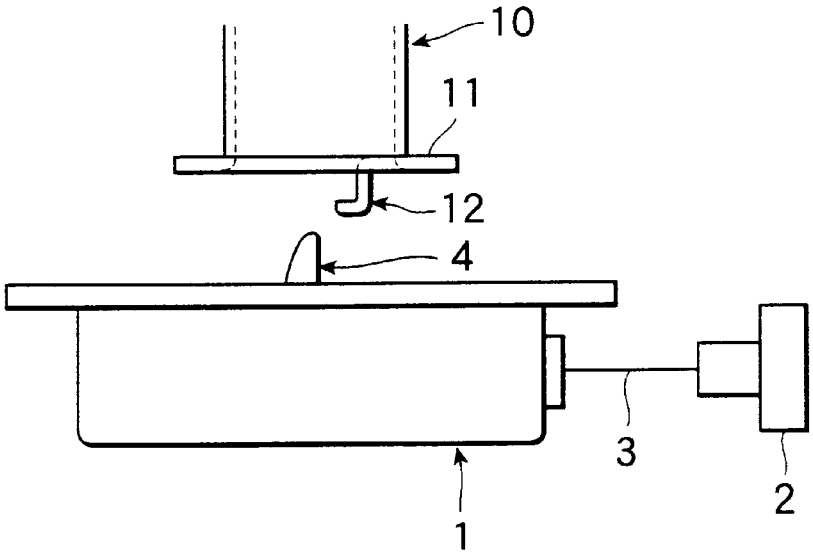
FIG. 6 shows a partial side view of the crank pulley according to the FIG. 4 and recoil starter corresponding thereto.

FIGS. 4 to 6 show the first embodiment of the present invention, in which FIG. 4 shows a partial side view of the crank pulley 10, and FIG. 5 shows a partial bottom view of the FIG. 4.

The crank pulley 10 in the embodiment was formed into nearly cup shape by press forming a steel plate, and an L-shape touching nail 12 was protruded from a flange 11, which was provided at an opening end towards reverse to an engine side. The touching nail 12 was made of punched face in steel plate, a corner part 15 of the contacting end face 14, which is in a thickness direction, i.e., at the opposite side of the engine, and at an outer corner of the bent part 13 formed into a curved or chamfered shape.

In a case of a small type engine, the curved or chamfered shape in the corner part 15 is not specifically necessary, and may sometimes obtain a sufficient advantage by flash, which will be inherently caused in the pressing operation.

There may be a plurality of touching nails 12, corresponding to a number of the dogs provided in the recoil starter.

A function of said crank pulley 10 is explained with reference to FIGS. 6 and 7.

Figure 7:
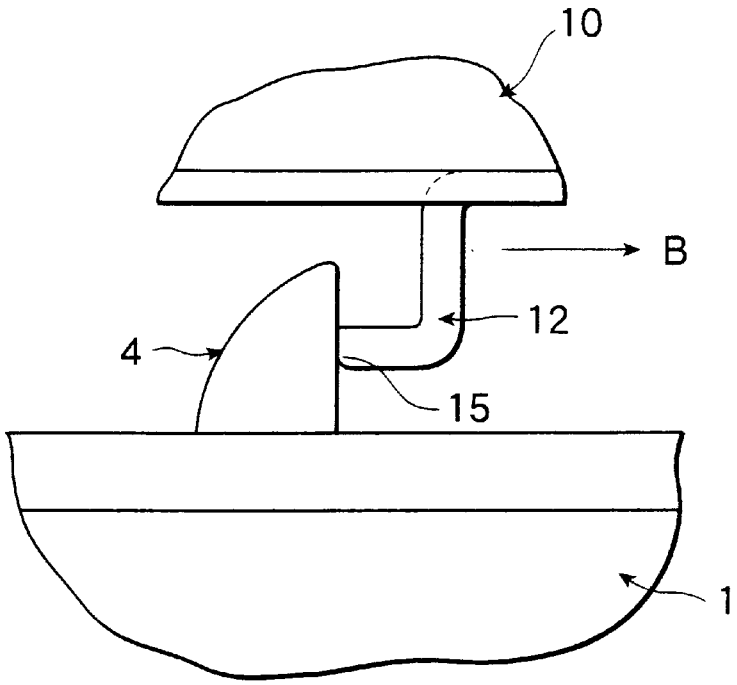
FIG. 7 shows a partial side view of the explanation drawing for function of the crank pulley according to the FIG. 4.

When a rope 3 is pulled by handle 2 against a coil spring (not shown in the drawing) enclosed in the recoil starter 1, the dog 4 is rotated around its axis by way of a reel (not shown in the drawing), and is moved to an axis direction at the engine side to contact with the touching nail 12 in the crank pulley 10, which is assembled with a crank axis (not shown in the Drawings) of the engine (FIG. 7). The dog 4 is forced to move the crank pulley 10 in a direction of the arrow mark, and the crank pulley 10 is revolved in a starting direction to start the engine. By loosening the rope 3 after starting the engine, the dog 4 is returned to the initial position by way of the reel, with a rotation in the reverse direction, by function of the afore mentioned coil spring.

Figure 8:
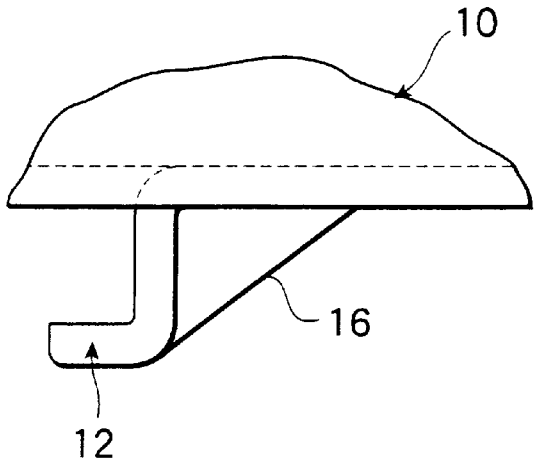
FIG. 8 shows a partial side view of the crank pulley according to another embodiment.

FIG. 8 shows a partial view of the touching nail in the crank pulley 10, in which triangled rib is formed between the joint nail 12 and the flange of the crank pulley, in order to strengthen the touching nail 12, and to make smooth the relative movement of the dog 4 to allow the A direction, when the touching nail 12 collides with a back face 6 of the dog 4.

Figure 9:
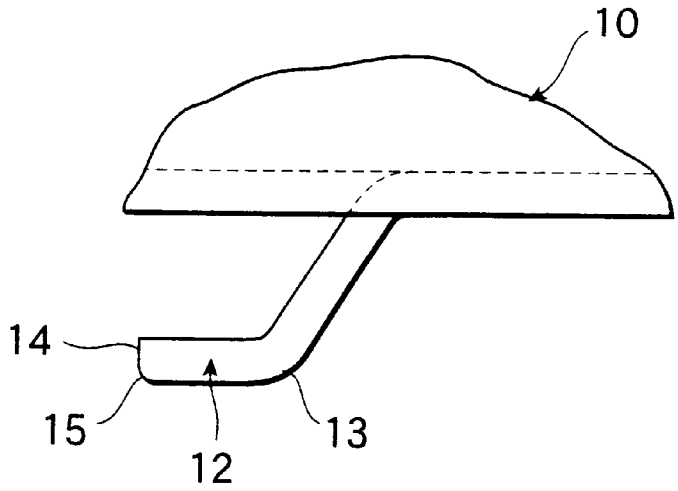
FIG. 9 shows a partial side view of the crank pulley according to further embodiment.

FIG. 9, which differs from the embodiment above, shows a partial view of the joint nail and the crank pulley, which is protruded on a slant in a direction adverse to the rotation of the crank pulley with respect to the flange 11. According to this crank pulley, a collision impact with the dog becomes moderate, and provides for a smooth rotation.

Figure 10:
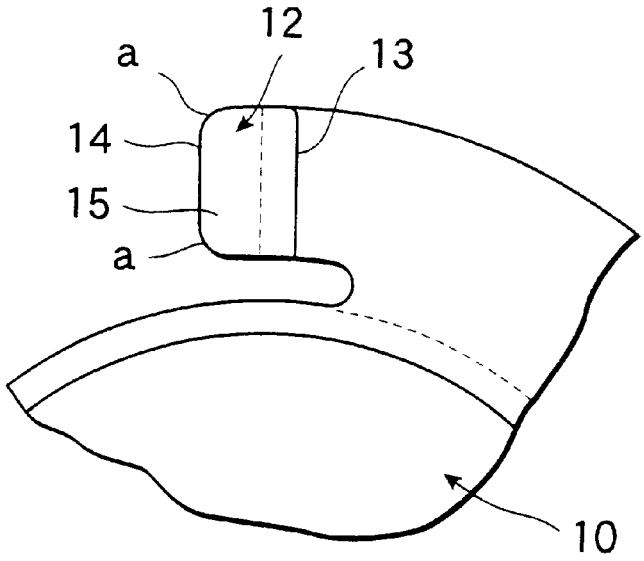
FIG. 10 shows a partial bottom view of the crank pulley according to still further embodiment.

FIG. 10 shows a partial bottom view of the touching nail 12 in crank pulley 10, in the which corner part in radial direction of the end face 14 in the touching nail are formed a curved or chamfered shape. The curved or chamfered shape is also preferably formed at a bent part "a". Both corner parts in a radial direction of end face 14 in the touching nail are formed in curved or chamfered shape. The curved or chamfered shape is also preferably formed at "13".

What is claimed is:

1. A crank pulley comprising:

a recoil starter having a dog which is capable of moving towards an engine side along an axis direction during a starting operation; and a touching nail which is provided on a crank pulley and is capable of engaging with said dog, wherein said touching nail is integrally formed with said crank pulley by press forming in a shape of protrusion towards a recoil starter side and a top of said touching nail is bent towards said dog on the recoil starter side in an L shape, a top face of which is formed with an end face for contact with said dog.

2. The crank pulley for recoil starter according to claim 1, wherein a rib is formed between the touching nail and a flange in the crank pulley.

3. The crank pulley according to claim 1, wherein the touching nail is protruded towards an opposite to revolving direction of the crank pulley.

4. The crank pulley according to claim 1, wherein a both corner parts on the end face of the nail are formed in curved or chamfered shape.

* * * * *